US011566772B2

(12) United States Patent
Chen

(10) Patent No.: US 11,566,772 B2
(45) Date of Patent: Jan. 31, 2023

(54) LAMPSHADE

(71) Applicant: Ching-Hui Chen, Guangdong (CN)

(72) Inventor: Ching-Hui Chen, Guangdong (CN)

( * ) Notice: Subject to any disclaimer, the term of this patent is extended or adjusted under 35 U.S.C. 154(b) by 0 days.

(21) Appl. No.: 17/216,696

(22) Filed: Mar. 30, 2021

(65) Prior Publication Data

US 2021/0310631 A1 Oct. 7, 2021

(30) Foreign Application Priority Data

Apr. 3, 2020 (CN) ..... 202020476659.5

(51) Int. Cl.
*F21V 1/14* (2006.01)
*F21V 1/16* (2018.01)
*F21V 1/06* (2006.01)

(52) U.S. Cl.
CPC ..... *F21V 1/143* (2013.01); *F21V 1/06* (2013.01); *F21V 1/16* (2013.01)

(58) Field of Classification Search
CPC ..... F21V 1/16; F21V 1/143; F21V 1/06
See application file for complete search history.

(56) References Cited

U.S. PATENT DOCUMENTS 2,585,176 A * 2/1952 Scherer ..... F21V 1/00 362/358
2,936,518 A * 5/1960 Schneider ..... B29C 66/5241 156/196
3,022,417 A * 2/1962 Linderoth ..... F21V 1/06 362/358
3,787,676 A * 1/1974 Korach ..... F21V 1/06 362/352
4,055,760 A * 10/1977 Weisbrod ..... F21V 17/007 362/352
8,992,054 B1 * 3/2015 Grollmus ..... F21V 17/002 362/351
9,927,089 B1 * 3/2018 Hsieh ..... F21V 1/143
10,641,460 B1 * 5/2020 Chen ..... F21V 1/143
2003/0002287 A1 * 1/2003 Juang ..... F21V 1/06 362/352
2012/0320605 A1 * 12/2012 Wu ..... F21V 1/143 362/351
2013/0010477 A1 * 1/2013 Wu ..... F21V 17/007 362/351

(Continued)

FOREIGN PATENT DOCUMENTS

NL 3112744 * 7/2015 ..... F21V 17/02

*Primary Examiner* — Zheng Song
(74) *Attorney, Agent, or Firm* — WPAT, PC

(57) ABSTRACT

The present utility model discloses a lampshade comprising fasteners, a lampshade body and support frames; the lampshade body comprises a light transmitting sheet and a piece of lampshade cloth; the bottom and/or top of the lampshade body are/is designed with soft band-shaped reinforcing ribs which extend in the length direction of the side wall surface and cover the lampshade body and prop up against at least one fastener; in the present utility model, the bottom and/or top of the lampshade body are/is designed with soft band-shaped reinforcing ribs which extend in the length direction of the side wall surface, the integration of the reinforcing ribs and the matching fasteners with the flexibility of the soft material makes the lampshade easy to be packaged and reduce the volume of its package and finally lower the transportation cost.

10 Claims, 8 Drawing Sheets

(56) References Cited

U.S. PATENT DOCUMENTS

| | | | | |
|---|---|---|---|---|
| 2013/0201695 | A1* | 8/2013 | Lewis | F21V 1/02 362/353 |
| 2016/0201871 | A1* | 7/2016 | Anderson | F21V 1/06 362/352 |
| 2018/0010761 | A1* | 1/2018 | Hong | F21V 1/06 |
| 2018/0119927 | A1* | 5/2018 | Warren, II | F21V 1/08 |
| 2018/0292072 | A1* | 10/2018 | Carroll | F21V 1/143 |
| 2019/0056084 | A1* | 2/2019 | Liao | F21V 1/143 |

* cited by examiner

LAMPSHADE

BACKGROUND OF THE INVENTION

The present utility model relates to the field of lamp design, in particular relates to a lampshade.

The lampshades are designed surrounding the flames of lamps or on the lamps for gathering light or keeping out the wind; in the prior art, the lampshades themselves are structure-defective, for example, the bottom and/or top of one of such lampshade are/is designed to be made from relatively hard materials; the materials for the light transmitting sheets are thick and hard; therefore, when packaging such lampshades, it is difficult to fold or bundle up them very well, and as a result, their packaging volumes are excessively big and it is necessary to use relatively big packaging boxes to hold such products, increasing the packaging and transportation costs; in addition, as shown in FIG. 1 of the SPECIFICATIONS, the holes for the fasteners of lampshades based on the prior art to pass through are designed on the lampshade bodies consisting of lampshade cloth and light transmitting sheets; after passing through the lampshades, one end of the fastener buckling parts is located on one side of the light transmitting sheet and the base on the other side is located on one side of the lampshade cloth; edge strips are designed at the position of the lampshade cloth passing through the fastener holder with the aim to keep out the wind and fix the fasteners onto the lampshade body, but such design affects the overall aesthetic feeling of lamps.

BRIEF SUMMARY OF THE INVENTION

The main purpose of the present utility model is to provide a lampshade and thus solve such a problem that the volume of lampshade package is excessively big as well as the packaging and transportation costs are too high.

To achieve the purpose described above, the present utility model provides a lampshade, comprising:

fasteners;

a lampshade, wherein the lampshade body comprises a light transmitting sheet and a piece of lampshade cloth, the bottom and/or top of the lampshade body are/is designed with soft band-shaped reinforcing ribs which extend in the length direction of the side wall surface and cover the lampshade body and prop up against at least one fastener; and support frames, where the support frames and the lampshade body are buckled and fixed via the fasteners and thus form a hollow barrel-shaped structure;

there is a part extending the light transmitting sheet respectively at the upper and lower ends of the lampshade cloth and such parts are designed with holes for the fasteners to pass through at the positions corresponding to the fasteners.

Further, the side of the reinforcing rib in the length direction is designed with fluff.

Further, the fasteners are uniformly distributed on the lampshade body.

Further, any of the reinforcing rib is arranged in one section or in several sections.

Further, the fasteners comprise the base and the buckling part which is integrated into the base, and the fasteners prop up against the reinforcing ribs via the base.

Further, the width of the base is greater than the width of the holes.

Further, the buckling part buckling the fasteners and the support frames is a U-groove structure, the width of the mouth of the groove is smaller than the width of the internal groove, the buckling part forms a U-shaped cavity so that the fasteners have the space for clipping the frame rings of the support frames.

Further, the front and rear ends of the lampshade body are designed with mutually matching connections which are hook and loop fasteners or rubber magnets.

Further, the support frames comprise the upper and lower support frames; the inside gusset of one of the upper and lower support frames is designed with a lamp holder for installing the lamp; the lamp holder is connected with the support frames via a plurality of connections arranged at intervals; one end of the connections are connected and fixed onto the support frames and the other end are connected and fixed onto the lamp holder.

Further, an extending part comprises a first folding edge and a second folding edge; when being folded, the first folding edge and the second folding edge form the space for the reinforcing ribs; after being folded, the extending parts cover the reinforcing ribs and the fasteners and the edges of the extending parts are connected and fixed with the inner side of the light transmitting sheet.

In the technical solution based on the present utility model, the bottom and/or top of the lampshade body are/is designed with soft band-shaped reinforcing ribs which extend in the length direction of the side wall surface; the integration of the reinforcing ribs and the matching fasteners with the flexibility of the soft material makes the lampshade easy to be packaged and reduce the volume of its package and finally lower the transportation cost; meanwhile, the extending parts designed for the lampshade cloth fold and cover the fasteners on the inner side of the light transmitting sheet of the lampshade body and thus increase the aesthetic feeling of the lampshade.

Wherein the above drawings include the following marks: 1: lampshade body; 11: lampshade cloth; 12: light transmitting sheet; 111: extending part; 1111: first folding edge; 1112: second folding edge; 112: hole; 113: hook and loop fastener; 2: support frame; 211: lamp holder; 212: connection; 3: fastener; 31: buckling part; 32: base; 4: reinforcing rib; 100: schematic stereoscopic diagram of lampshade in the prior art; 1003: fastener of lampshade in the prior art.

DETAILED DESCRIPTION OF THE INVENTION

The technical solutions of the present utility model will be described more clearly and fully in conjunction with the accompanying drawings of the present utility model, and obviously, the described embodiments are merely a part of the embodiments of the present utility model, not all the embodiments. Based on the embodiments of the present utility model, all the other embodiments obtained by the ordinary skilled in the art without creative labors belong to the scope claimed by the present utility model.

It should be noted that if an embodiment of the present utility model relates to directive instructions (such as upper, lower, left, right, front, rear, top, bottom, inside, outside, vertical, transverse, longitudinal, counter-clockwise, clockwise, circumferential, radial and axial), these directive instructions are merely used to explain the relative position relationship, the movement and so on among the components at certain specific posture (as shown in the accompanying drawings); if the specific posture changes, the directive instructions should be changed accordingly.

In addition, if an embodiment of the present utility model relates to the descriptions such as "first" and "second", these descriptions are merely used for description and should not be understood to indicate or imply their relative importance or implicitly indicate the number of the corresponding technical features. This shows that the features limited with "first" and "second" can explicitly or implicitly include one such feature at least. Moreover, the technical solutions among the embodiments can be in combination with each other; however, such combination must be on the premise that those skilled in the art can realize the related technical solutions; when the technical solutions are inconsistent or cannot be realized, such combination of technical solutions should be deemed to be inexistent and not in the scope claimed by the present utility model.

The present utility model provides a lampshade.

Figure 1:
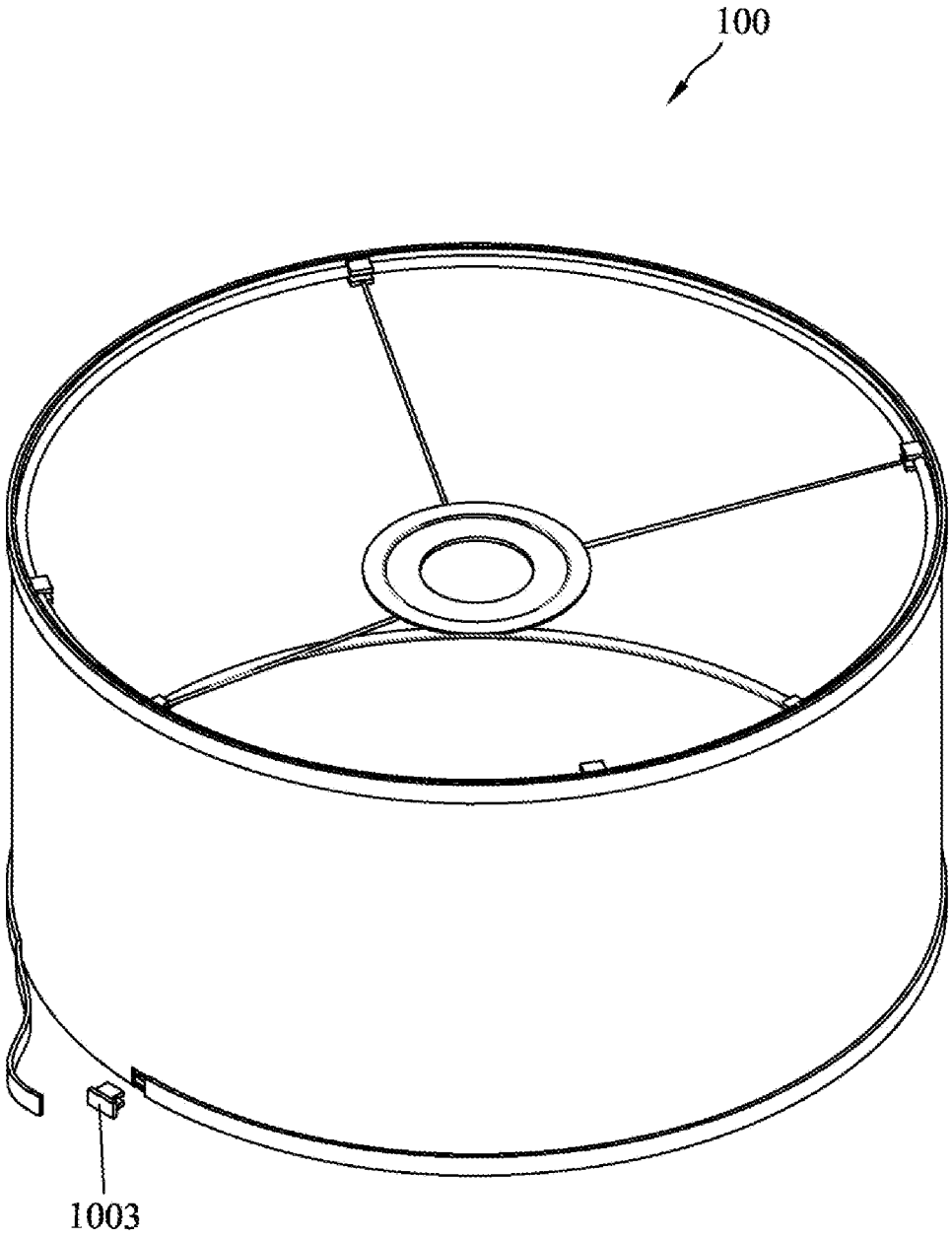
FIG. 1 is a schematic stereoscopic diagram for a lampshade based on the prior art.
Figure 2:
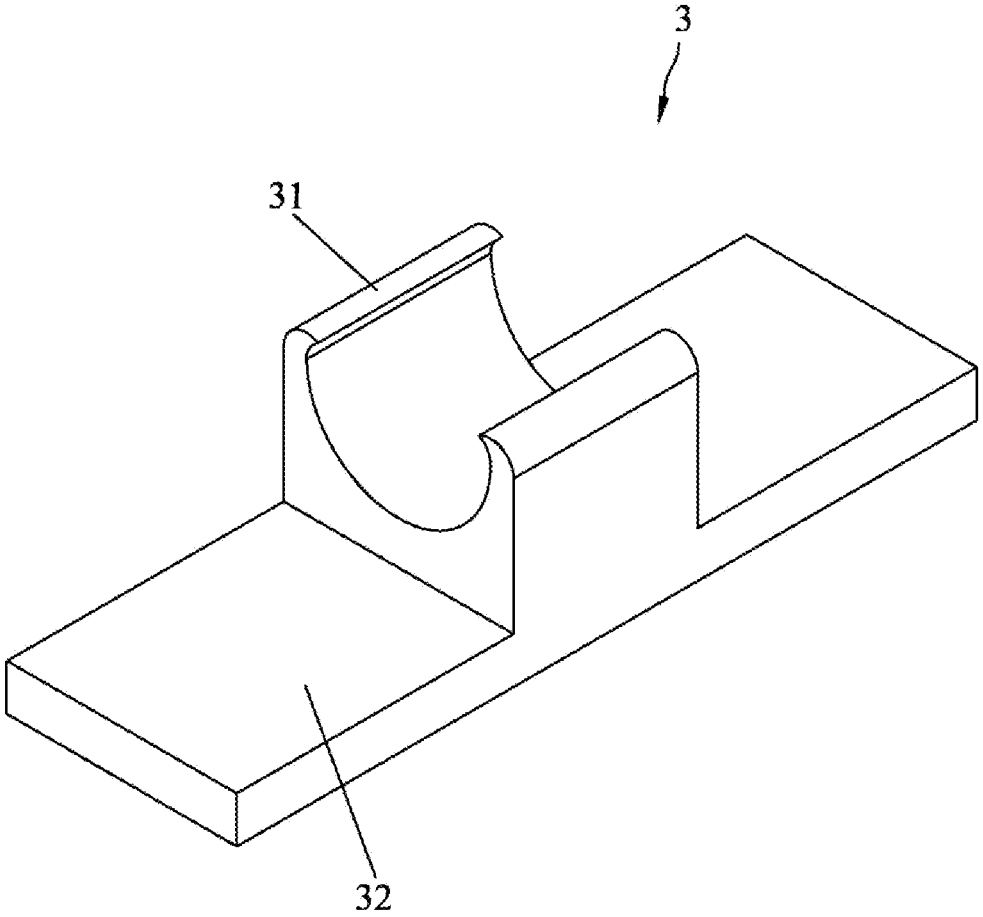
FIG. 2 is a stereoscopic diagram for a fastener of the lampshade based on the present utility model.
Figure 3:
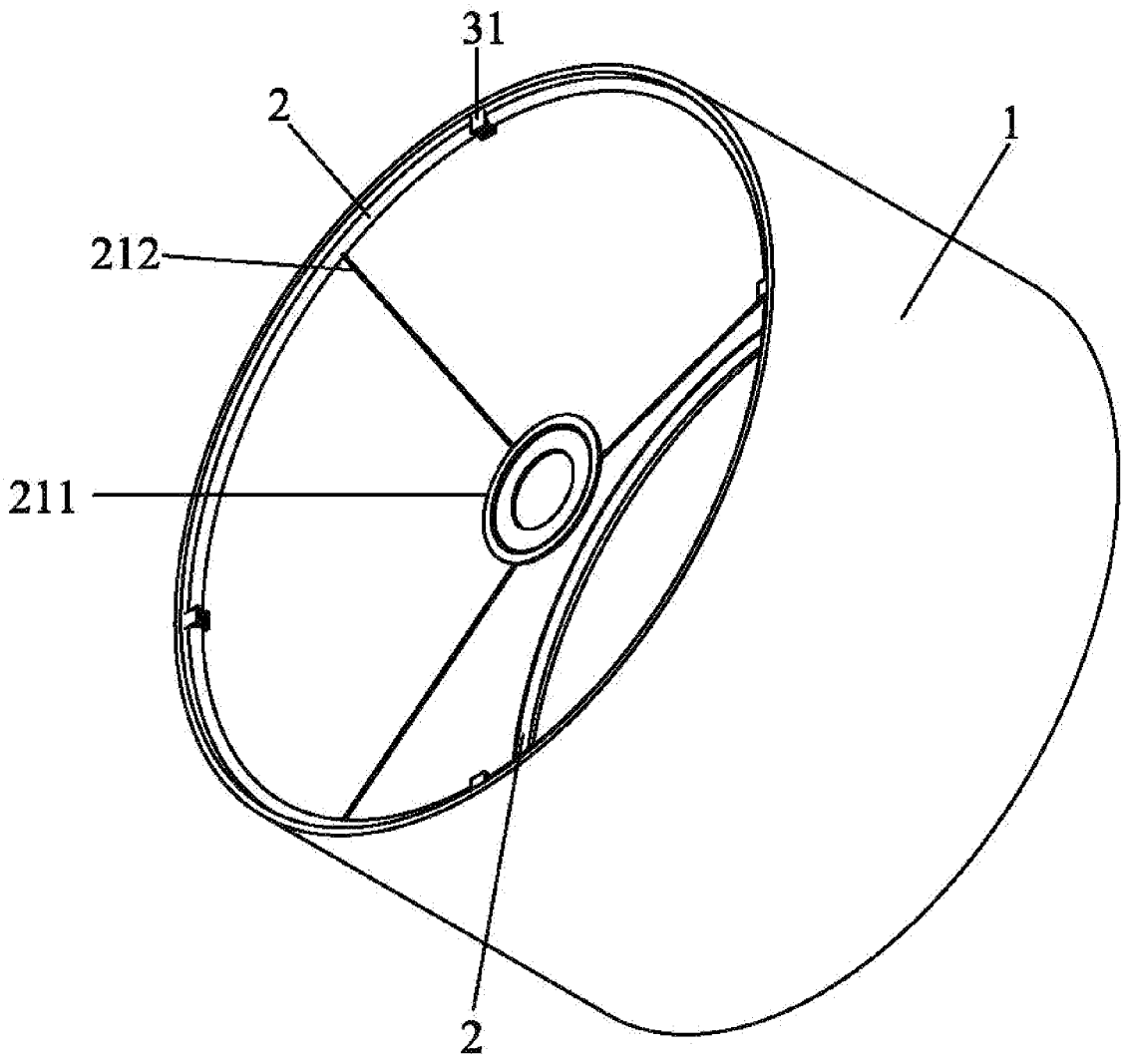
FIG. 3 is a stereoscopic diagram for Embodiment I of the lampshade based on the present utility model.
Figure 4:
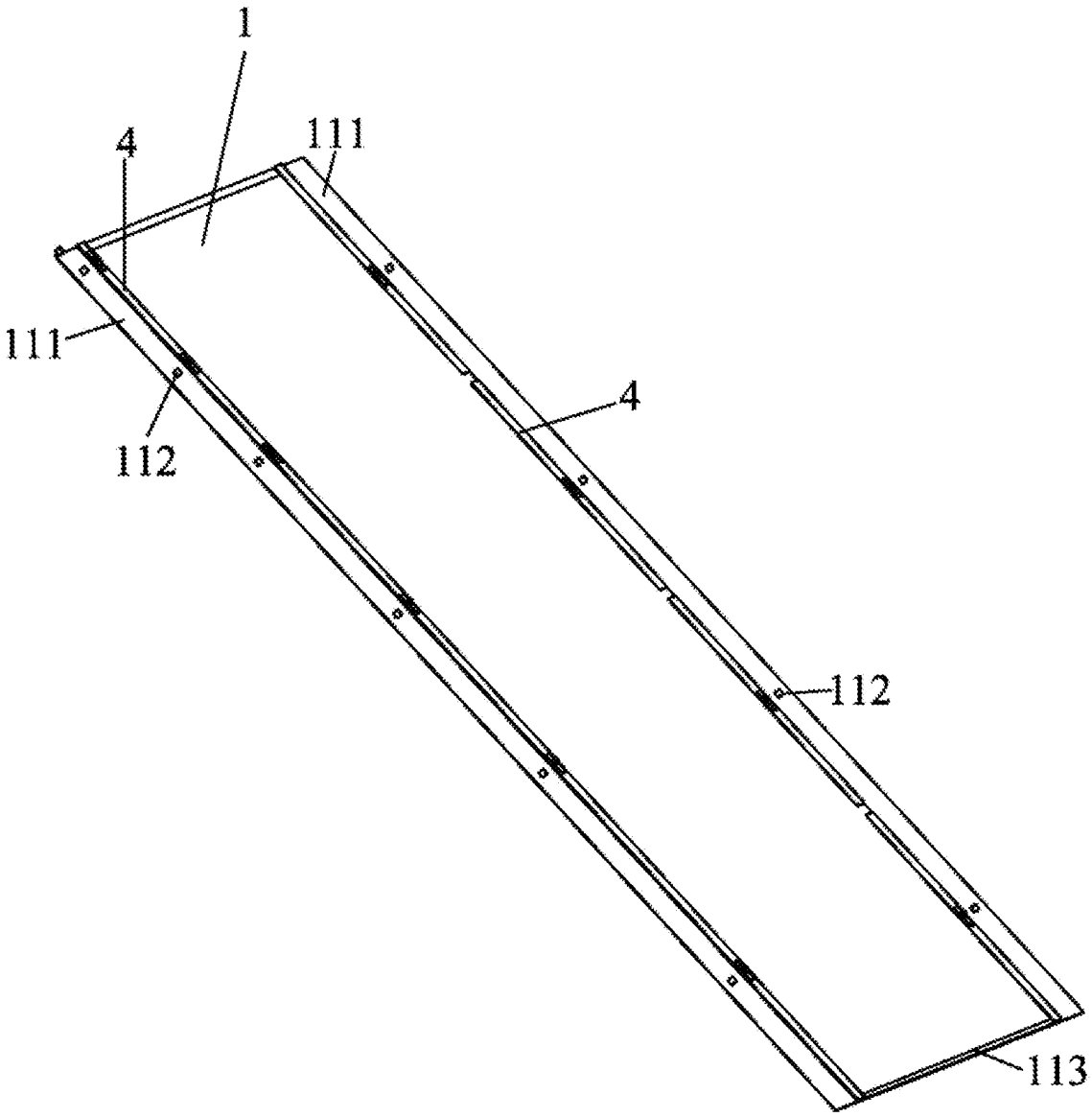
FIG. 4 is Schematic Diagram I for the unfolded lampshade body in Embodiment I of the lampshade based on the present utility model.
Figure 5:
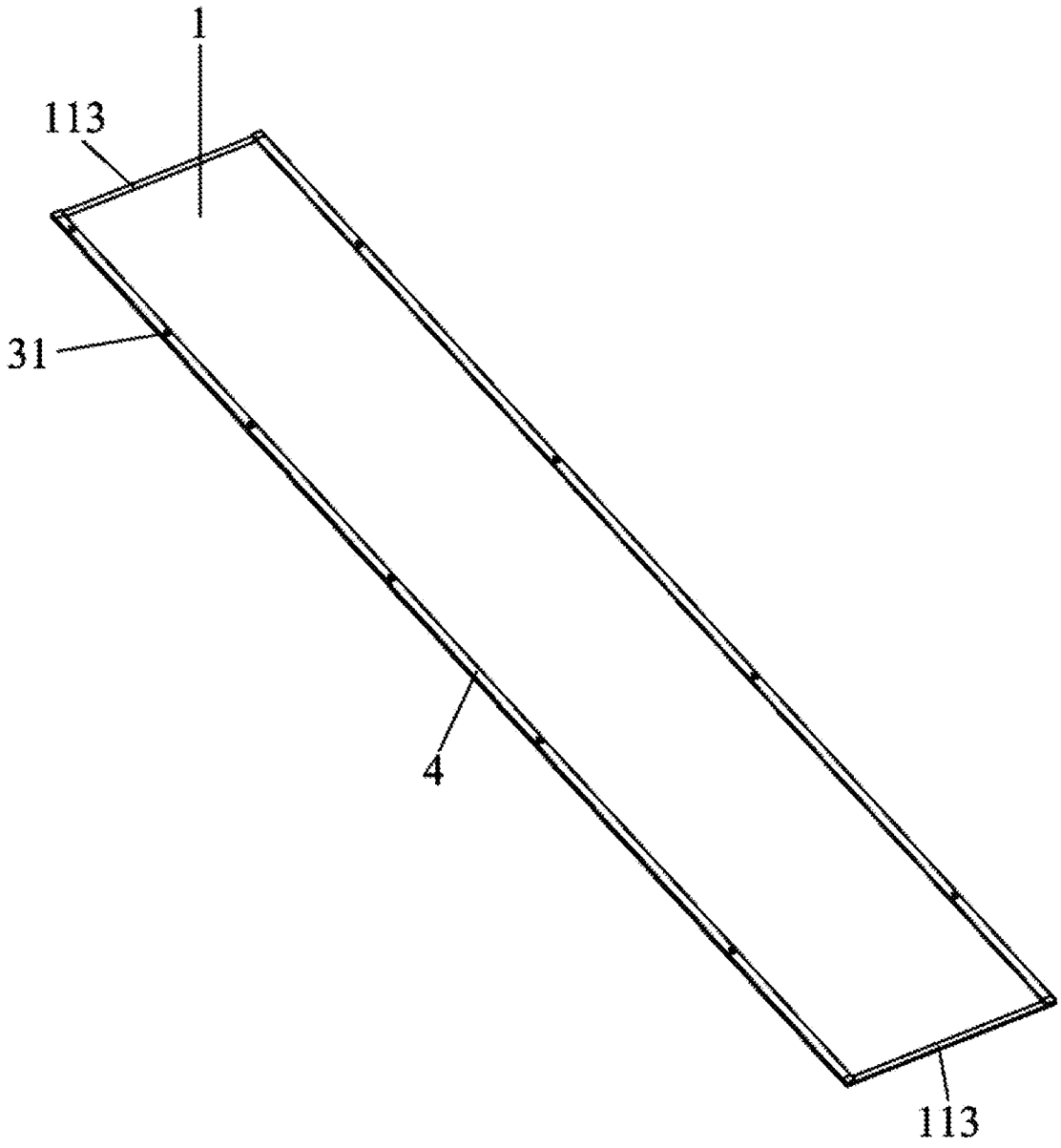
FIG. 5 is Schematic Diagram II for the unfolded lampshade body in Embodiment I of the lampshade based on the present utility model.
Figure 6:
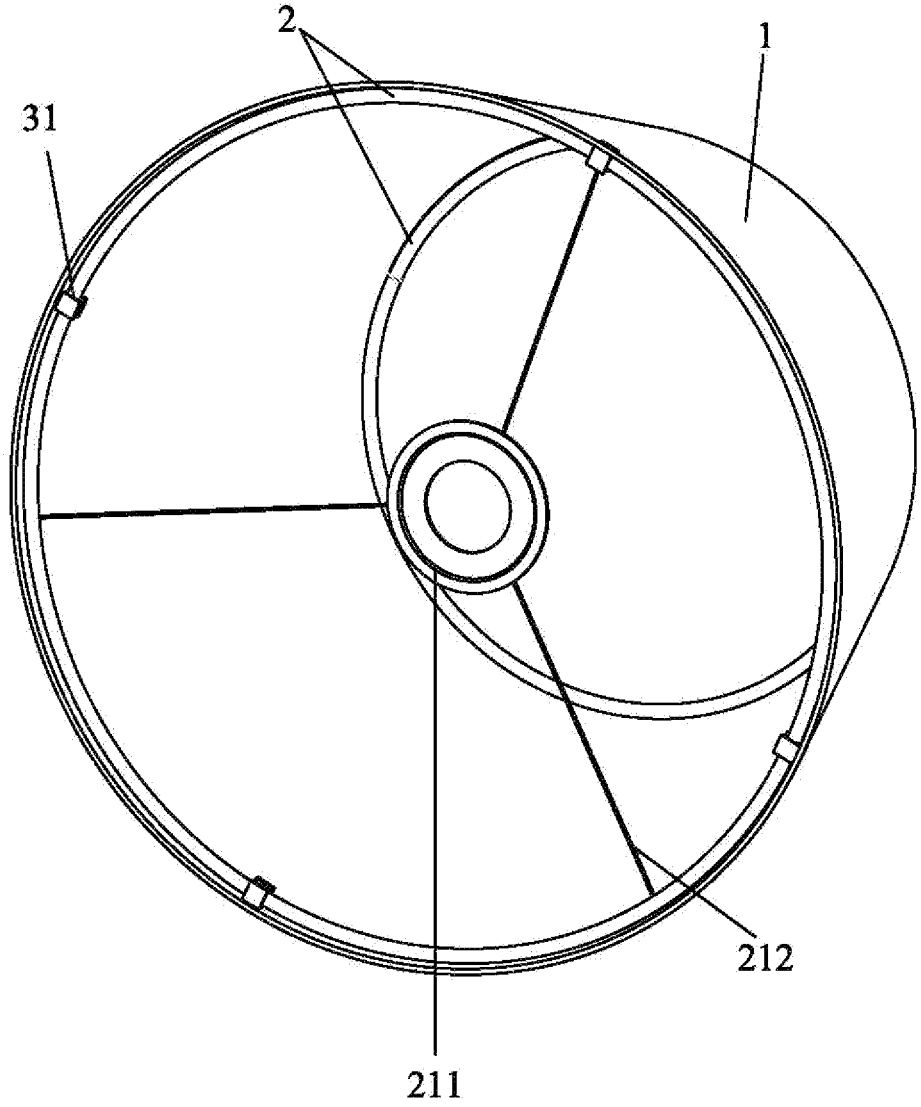
FIG. 6 is a stereoscopic diagram for Embodiment II of the lampshade based on the present utility model.
Figure 7:
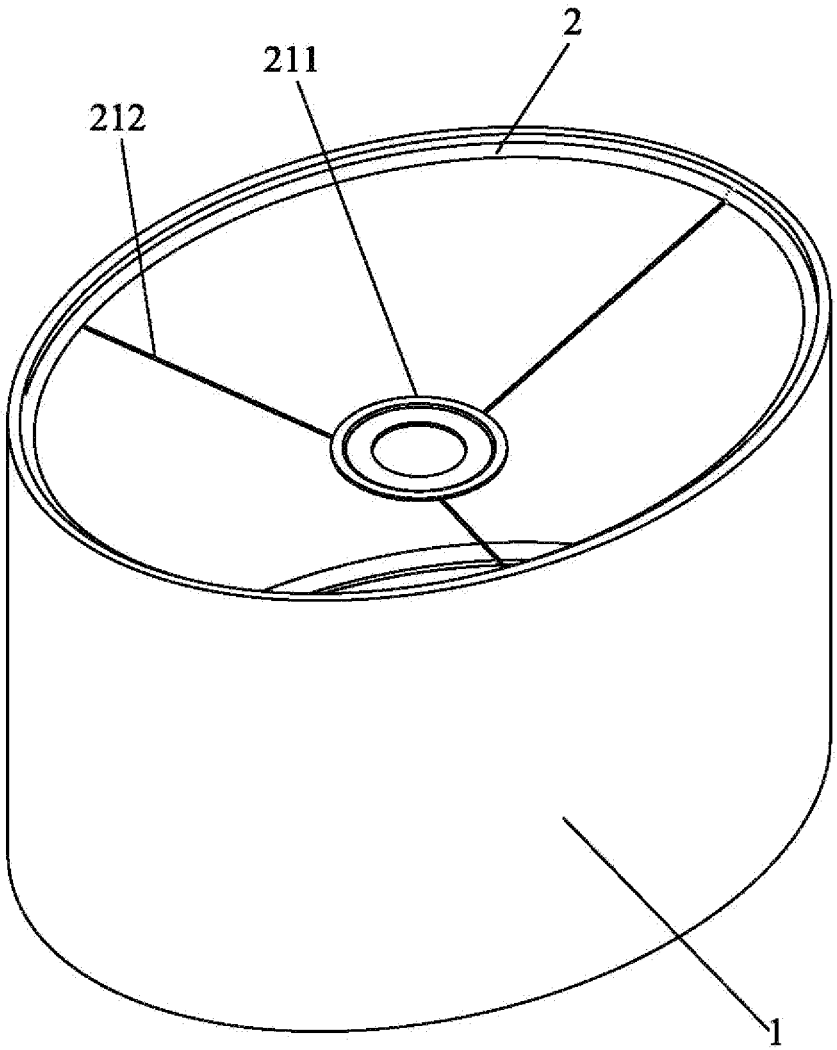
FIG. 7 is a stereoscopic diagram for Embodiment III of the lampshade based on the present utility model.
Figure 8:
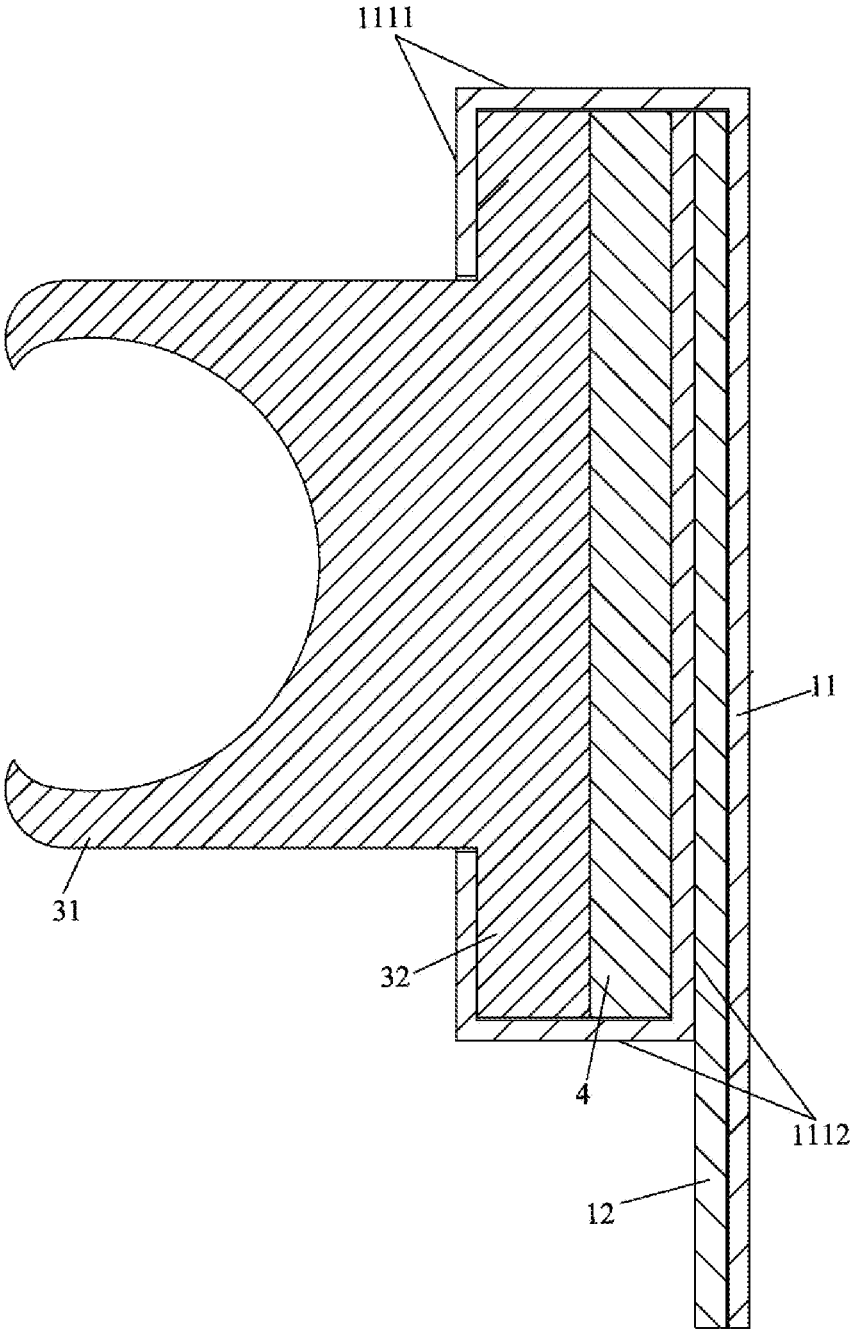
FIG. 8 is a cutaway view of matching the fastener with the lampshade body of the lampshade based on the present utility model.

In an embodiment of the present utility model, as shown in FIG. 1 to FIG. 8, the lampshade comprises fasteners (3), a lampshade body (1) and support frames (2);

Wherein the lampshade body (1) comprises a light transmitting sheet (12) and a piece of lampshade cloth (11), the bottom and/or top of the lampshade body (1) are/is designed with soft band-shaped reinforcing ribs (4) which extend in the length direction of the side wall surface and cover the lampshade body and prop up against at least one fastener (3);

The support frames (2) and the lampshade body (1) are buckled and fixed via the fasteners (3) and thus form a hollow barrel-shaped structure;

There is a part (111) extending the light transmitting sheet (12) respectively at the upper and lower ends of the lampshade cloth (11) and such parts (111) are designed with holes (112) for the fasteners (3) to pass through at the positions corresponding to the fasteners; the holes (112) can be square or circular; the sides of the reinforcing ribs (4) in the length direction are connected with the fasteners (3).

Concretely, the shape of the lampshade body (1) can be circular (see FIG. 3) or oval (see FIG. 7) or tapered (see FIG. 6); in this embodiment, the lampshade body (1) is circular; in this embodiment, the support frame (2) is circular, same as the lampshade body (1).

Further, the lampshade cloth (11) is pasted and fixed onto the outer side of the light transmitting sheet (12). In this embodiment, the lampshade cloth (1) is pasted and fixed on the outside surfaces of the side walls via waterproof glue which is highly flexible, waterproof and damp[-roof with strong adhesive property and strong resistance to cracking; in daily use, it is necessary to remove, clean and dry the shade (1) in the sun at intervals; the ordinary glue will gradually lose its adhesive property and crack at the pasting positions after being water-cleaned and dried in the sun repeatedly while the shade (1) pasted with the waterproof glue still can maintain the adhesive property of the waterproof glue after being water-cleaned and dried in the sun repeatedly and thus prolong the service life of the lampshade.

Further, the side of the reinforcing rib (4) in the length direction is designed with fluff for the convenience of matching it with the lampshade cloth wherein the fluff has certain adhesive strength and thus can provide auxiliary fixing effect when the lampshade is installed.

Further, the fasteners (3) are uniformly distributed on the lampshade body (1).

Further, the reinforcing rib (4) is arranged in one section or in several sections.

Further, a fastener (3) comprises the base (32) and the buckling part (31) wherein the buckling part (31) is integrated into the base (32), the fastener (3) props up against the reinforcing rib (4) via the base (32); the number of fasteners (3) can be adjusted correspondingly as per the actual situation; preferably, the quantity is designed to be 4, and the 4 fasteners (3) are uniformly arranged, not only ensuring the stability of installation but also ensuring the aesthetic feeling.

Concretely, the fasteners (3) can be made from rubber, plastic or metal material; the preferable material in this embodiment is plastic.

Further, the width of the base (32) is greater than the width of the hole (112); during its use, the lampshade will be assembled and disassembled constantly; in this process, the fasteners and the support frames will produce forces and thus prevent the base (32) from coming off from the lampshade cloth and affecting the normal use of lampshade; however, it is also inappropriate if the width of the base (32) is excessively big because the base (32) is preferably made from hard plastic; to be specific, if the base (32) is excessively big, the whole lampshade cannot be folded or bundled up very well, in this case, the volume of its package will be excessively big and not convenient for packaging and finally increase the packaging and transportation costs.

Further, the buckling part (31) buckling the fasteners (3) and the support frames (2) is a U-groove structure, the width of the mouth of the groove is smaller than the width of the internal groove, the buckling part (31) forms a U-shaped cavity so that the fasteners (3) have the space for clipping the frame rings of the support frames (2) and thus ensure that the fasteners (3) and the support frames (2) can be buckled and dismantled mutually.

Further, the front and rear ends of the lampshade body (1) are designed with mutually matching connections which are hook and loop fasteners or rubber magnets (113); if the connections are rubber magnets (113), there will be two design schemes that both the front and rear ends are rubber magnets (113) or one end is rubber magnet (113) and the other end is sheet iron; the side on which they match up is designed on the outer side of the lampshade cloth (11) and the other side is designed on the inner surface of the light transmitting sheet (12) on the inner side; such design is convenient to assemble and disassemble the lampshade efficiently.

Further, the support frames (2) comprise the upper and lower support frames, made from metal or plastic material; in order to ensure the stability and structural strength of the lampshade, the support frames (2) in this embodiment are made from metal material. The inside gusset of one of the upper and lower support frames is designed with a lamp holder (211) for installing the lamp; the lamp holder (211) is connected with the support frames (2) via a plurality of connections (212) arranged at intervals; one end of the connections (212) is connected and fixed onto the support frames (2) and the other end are connected and fixed onto the lamp holder (211).

Further, an extending part (111) comprises a first folding edge (1111) and a second folding edge (1112); when being folded, the first folding edge (1111) and the second folding edge (1112) form the space for the reinforcing ribs; after being folded, the extending parts cover the reinforcing ribs (4) and the fasteners (3) and the edges of the extending parts are connected and fixed with the inner side of the light transmitting sheet (12) via waterproof glue.

In the technical solution based on the present utility model, the bottom and/or top of the lampshade body are/is designed with soft band-shaped reinforcing ribs which extend in the length direction of the side wall surface; the integration of the reinforcing ribs and the matching fasteners with the flexibility of the soft material makes the lampshade easy to be packaged and reduce the area of its package and finally lower the packaging and transportation costs; meanwhile, the extending parts (111) designed via the lampshade cloth (11) fold and cover the fasteners (3) on the inner side of the light transmitting sheet (12) of the lampshade body (1) and thus increase the aesthetic feeling of product.

The embodiments described above are merely the preferred embodiments of the present utility model, not to limit the patent scope of the present utility model; with the conception of the present utility model, any equivalent structure transformation using the Specifications and the accompanying drawings of the present utility model or direct/indirect applications to other related technical fields should be included in the scope claimed by the present utility model.

What is claimed is:

1. A lampshade wherein the lampshade comprises:

fasteners; a lampshade body;

wherein the lampshade body comprises a light transmitting sheet and a piece of lampshade cloth, wherein a bottom and/or top of the lampshade body is/are designed with soft band-shaped reinforcing ribs which extend in a length direction of a side wall surface of the lampshade body and cover the lampshade body and prop up against the fasteners; and support frames, where the support frames and the lampshade body are buckled and fixed via the fasteners and thus form a hollow barrel-shaped structure;

parts of the lampshade cloth extending at the upper and lower ends of the lampshade cloth and surpassing the light transmitting sheet are designed with holes for the fasteners to pass through at corresponding positions.

2. The lampshade in accordance with claim 1, wherein the fasteners comprise a base and a buckling part which is integrated into the base, and the fasteners prop up against the reinforcing ribs via the base.

3. The lampshade in accordance with claim 2, wherein the width of the base is greater than the width of the holes.

4. The lampshade in accordance with claim 2, wherein the buckling part buckling the fasteners and the support frame is a groove structure, a width of a mouth of the groove structure is smaller than a width of an internal groove of the groove structure, the buckling part forms a U-shaped cavity in the groove structure so that the fasteners have space for clipping a frame ring of the support frame.

5. The lampshade in accordance with claim 1, wherein a side of the reinforcing ribs in a length direction is designed with fluff.

6. The lampshade in accordance with claim 5, wherein the extending parts of the lampshade cloth comprise a first folding edge and a second folding edge; when being folded, the first folding edge and the second folding edge form the space for the reinforcing ribs; after being folded, the extending parts cover the reinforcing ribs and the fasteners and the edges of the extending parts are connected and fixed with the inner side of the light transmitting sheet.

7. The lampshade in accordance with claim 1, wherein the fasteners are uniformly distributed on the lampshade body.

8. The lampshade in accordance with claim 1, wherein any of the reinforcing ribs is arranged in one section or in several sections.

9. The lampshade in accordance with claim 1, wherein front and rear ends of the lampshade body are designed with mutually matching connections which are hook and loop fasteners or rubber magnets.

10. The lampshade in accordance with claim 1, wherein an inside gusset of an upper support frame or a lower support frame of the support frames is designed with a lamp holder for installing a lamp; the lamp holder is connected with the upper support frame or the lower support frame via a plurality of connections arranged at intervals; one end of the connections is connected and fixed onto the upper support frame or the lower support frame and the other end are connected and fixed onto the lamp holder.

* * * * *